United States Patent [19]

Clouser et al.

[11] Patent Number: 4,550,874

[45] Date of Patent: Nov. 5, 1985

[54] MEANS CONTROLLING A FLUE DAMPER

[75] Inventors: Michael T. Clouser, Indianapolis; Robert S. Coulter, Plainfield, both of Ind.

[73] Assignee: Emhart Industries, Inc., Indianapolis, Ind.

[21] Appl. No.: 580,797

[22] Filed: Feb. 16, 1984

Related U.S. Application Data

[63] Continuation of Ser. No. 369,250, Apr. 16, 1982, abandoned.

[51] Int. Cl.[4] ..... F23N 3/00

[52] U.S. Cl. ..... 236/1 G; 431/20

[58] Field of Search ..... 236/1 G, 45; 110/147, 110/163; 126/285 B; 431/20

[56] References Cited

U.S. PATENT DOCUMENTS

| | | | |
|---|---|---|---|
| 2,155,642 | 4/1939 | Dewey | 236/1 G |
| 3,025,446 | 3/1962 | Leffler | 236/1 G X |
| 4,005,820 | 2/1977 | Cress | 236/1 G |
| 4,017,024 | 4/1977 | Grostick et al. | 236/1 G |
| 4,084,743 | 4/1978 | Matthews et al. | 236/1 G |
| 4,087,045 | 5/1978 | Matthews | 236/1 G |
| 4,295,603 | 10/1981 | Clouser | 236/1 G |
| 4,321,030 | 3/1982 | Matthews | 236/1 G X |
| 4,374,569 | 2/1983 | Hayes | 236/1 G |
| 4,389,014 | 6/1983 | Chow | 236/1 G |
| 4,439,139 | 3/1984 | Nelson et al. | 236/1 G X |

*Primary Examiner*—Harry Tanner

*Attorney, Agent, or Firm*—Robert F. Meyer

[57] ABSTRACT

A flue damper is rotated 360° in a predetermined direction in 90° increments to be selectively opened and closed in 90° increments. The incremental rotation is accomplished by a motor driven timing mechanism with power to the motor being controlled by the timing mechanism and a single pole double throw relay.

2 Claims, 2 Drawing Figures

MEANS CONTROLLING A FLUE DAMPER

This application is a continuation of application Ser. No. 369,250, filed Apr. 16, 1982, abandoned.

BACKGROUND OF THE INVENTION

Generally speaking, the present invention relates to a heating system wherein a flue damper regulates gas flow through a conduit from a heat source in accordance with a temperature demand means actuating the heat source, and more particularly to a controller connected to the flue damper that rotates it 360° in about 90° increments to selectively open and close the damper.

Numerous dampening systems for use in heat and smoke stacks have been proposed and used. Currently in some flue damper systems, for example, hysteresis type motors are used to drive a coil spring loaded flue plate against a stop thereby stalling the motor with the plate in a closed position. Then, when a thermostatic switch calls for heat, a relay is pulled in and power to the motor is broken. With the motor deenergized, the coil spring causes the flue plate to open by turning the motor backwards. Then, as the flue comes to full open position, a switch actuates a gas valve. While such an arrangement is acceptable, it does have some inherent problems. For example, a hysteresis type motor is expensive. The system requires a relatively large number of parts thus adding to fabrication costs. In addition, the use of the coil spring to return the flue to an open position causes inaccuracies with a certain amount of tendency to fail.

In another arrangement, a flue damper is connected to a motor to be rotated in accordance with a programmed sequence. The motor is turned on and off through a relay. The present application utilizes a relay but it is so connected as to render the system more reliable.

The present invention overcomes these problems and in addition provides for other features noted hereinafter.

FEATURES OR OBJECTS OF THE INVENTION

It is, therefore, a feature of the present invention to provide a heating system having a flue damper controller. Another feature of the invention is to provide a flue damper controller which is simple and economical to produce. Another feature of the invention is to provide a flue damper controller which opens and closes the damper in 90° increments through a 360° rotation. Still another feature of the invention is to provide such a controller which actuates the heat source when the damper is fully opened. Another feature of the invention is to provide such a controller which includes a motor drive means for rotating a timing means, and electrical circuit means including a single pole double throw relay selectively energizing and deenergizing the motor drive means.

DETAILED DESCRIPTION OF THE INVENTIION

Figure 1:
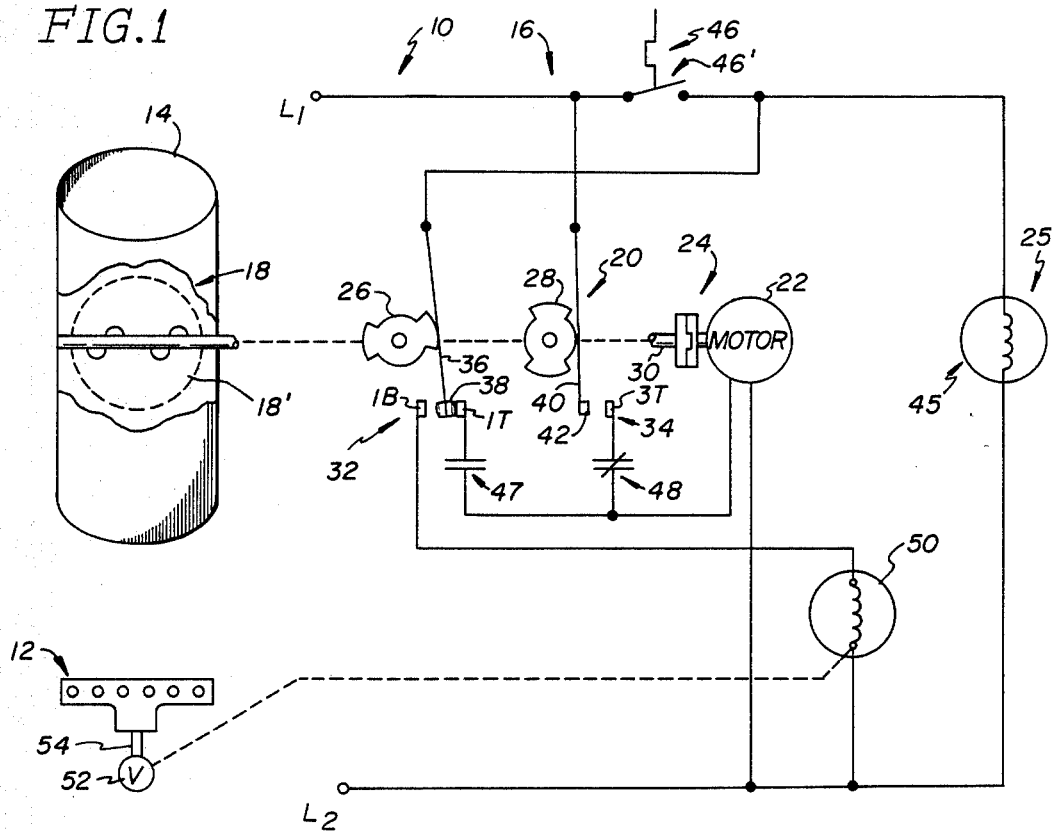
FIG. 1 is a schematic of the controller showing a flue damper in conjunction with a wiring diagram for the controller.

Referring to FIG. 1, there is shown a heating system 10 which, in general, includes a heat source 12 which supplies gas and combustion products through a conduit 14, and a controller 16 which regulates a flue damper 18 carried in conduit 14 and also regulates a supply of gas to heat source 12. The combustion products are suitably exhausted through conduit 14.

Controller 16 includes timing means 20 which is driven by a motor 22 through a suitable clutch means 24, and electrical circuitry 25 connecting the various electrical switches of the timing means 20 to the various functions of the heating system. Timing means 20 includes a pair of cams 26 and 28 carried on a shaft 30 to be rotated therewith, and electrical limit switch means 32 and 34 that are responsive to the cams. Electrical switch means 32 is of the double throw type and includes fixed electrical contacts 1B and 1T and movable contact blade 36 engaging cam 26 and having a double faced electrical contact 38 at its distal end to selectively engage electrical contacts 1B and 1T. Switch means 34 is of a single pole type having a fixed electrical contact 3T and movable contact blade 40 engaging cam 28 and having an electrical contact 42 at its distal end to selectively engage contact 3T. Shaft 30 is coupled to motor 22 through clutch means 24 to be rotated thereby and thus rotate cams 26 and 28.

Flue damper 18 includes a substantially flat circular plate 18' that is carried on shaft 30 to be rotated therewith. As will be hereinafter described, plate 18' is rotated through 360° in 90° increments to open and close conduit 14.

Electrical circuit 25 is connected across AC power source L1L2 and includes switch means 32 and 34, relay switch means 48 and 47, a temperature demand means 46 connected to relay coil 45, motor 22 that is connected at one end to both relay switch means 47 and 48, and a solenoid 50 connected to electrical contact 1B of switch means 32. Switch means 32 is a double throw switch having electrical contacts 1B and 1T while switch means 34 is a single throw switch. Switch means 47 and 48 constitutes a single pole double throw relay. Solenoid 50 is part of valve 52 which controls gas flow from a source (not shown) through a conduit 54 to heat source 12. Heat sourch 12 is of any suitable type such as a burner having a pilot valve (not shown). Temperature demand means 46 includes a thermostat 46' that is normally open prior to a heat cycle.

Figure 2:
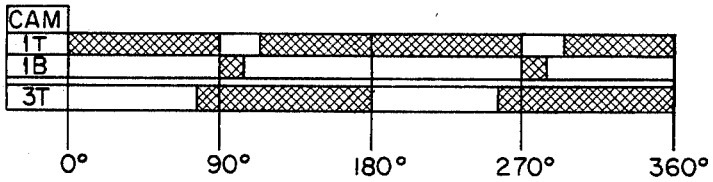
FIG. 2 is a time chart showing an operating sequence of the controller.

Referring to both FIGS. 1 and 2, the operation of the heating system can be described. At the 0° position of the time chart, contact 1T is made. When thermostat 46' calls for heat (or closes), an electrical path is made from L1 through the thermostat and through relay coil 45 to L2. The relay coil thus energized causes relay switch means 48, which is a normally closed contact, to open and simultaneously causes relay switch means 47, which is a normally open contact, to close. This relay switch action provides an electrical path from L1 through thermostat 46' through 1T contact, through relay switch means 47, and through motor 22 to L2. Motor 22 thus energized begins to run and simultaneously rotates cams 26 and 28 which control timer contacts 1B, 1T and 3T and flue plate 18'. Just prior to reaching the 90° position in FIG. 2, contact 3T closes and provides a partial electrical path from L1 to the motor 22.

When the flue plate 18' is at the full open position (90° in FIG. 2), contact 1T opens and simultaneously contact 1B closes. When 1T opens, the energizing path to motor 22 is broken and thus motor 22 stops. 1B thus made provides an electrical path from L1 through thermostat 46', through contact 1B and through solenoid 50 to L2. Solenoid 50 thus energized activates valve 52 and the heating cycle commences. When the thermostat 46' becomes satisfied and opens, the electrical paths to relay coil 45 and to solenoid 50, are broken. Relay 45 is thus deenergized and causes relay switch means 47 and 48 to change states. Thus relay switch means 47 opens and relay switch means 48 closes. Since contact 3T is already made, a new electrical path is provided from L1, through contact 3T, through relay switch means 48, and through motor 22 to L2. The motor thus energized begins to run and progresses from 90° on the time chart to 180°. Also, since solenoid 50 is deenergized when thermostat 46' opens, the heating cycle is terminated. Shortly after motor 22 starts, contact 1B is opened which prevents reignition of the appliance while the flue plate 18' is partially or fully closed.

Shortly after 1B opens but before reaching the 180° or the flue plate 18' closed position, contact 1T makes and provides a partial electrical path from L1 to the motor 22. As the 180° position is reached, contact 3T breaks and motor 22 thus comes to rest. At this point, the appliance (furnace) is off, the flue plate 18' is closed and the system is awaiting another call for heat. In the event of a motor failure, clutch means 24 can be used to override motor 22 and the controller manually set on the "on" position so that heating capability can be restored until servicing of the unit can take place.

What is claimed is:

1. In a heating system wherein heat is supplied from an electrically operable fuel supply source through a conduit;

a flue damper plate rotatably mounted for rotation within said conduit to regulate heat flow through said conduit and a controller controlling the position of said flue damper plate comprising:

(a) a temperature demand means response to a request for heat connected between a junction of a movable contact of a double throw switch and of a relay, and a movable contact of a single pole switch, said single pole switch closed when said flue damper plate is open, and open when said flue damper plate is closed, a first side of said double pole switch closed when said flue damper plate is closed and open when said flue damper plate is open, a second side of said double throw switch open when said flue damper plate is closed and closed when said flue damper plate is open, (b) said relay including a coil electrically connected between a second side of a power source, and through said temperature demand means to a first side of said power source, (c) a drive motor coupled to said flue damper plate and electrically connected between said second side of said power source and through a normally closed contact of said relay and through said single pole switch to said first side of said power source, and further connected between said second side of said power source and through a normally open contact of said relay, through a side of said double throw switch, and through said temperature demand means to said first side of said power source, and (d) said electrically operable fuel supply source connected between said second side of said power source and through a side of said double throw switch and said temperature demand means to said first side of said power source.

2. In a heating system according to claim 1 wherein said electrically operable fuel source is a solenoid operated valve.

* * * * *